United States Patent [19]

Krajcir et al.

[11] Patent Number: 4,908,963

[45] Date of Patent: Mar. 20, 1990

[54] SAFETY SHOE

[76] Inventors: Dezider Krajcir; Dezi A. Krajcir, both of P.O. Box 86, Dunnville, Ontario, Canada

[21] Appl. No.: 310,864

[22] Filed: Feb. 14, 1989

[51] Int. Cl.[4] ..... A43C 13/14

[52] U.S. Cl. ..... 36/77 R; 36/72 R

[58] Field of Search ..... 36/77 R, 77 M, 72 R, 36/113, 45

[56] References Cited

U.S. PATENT DOCUMENTS

| | | | |
|---|---|---|---|
| 2,836,909 | 6/1958 | Richards | 36/72 R |
| 3,102,347 | 9/1963 | Griswold et al. | 36/72 R |
| 4,102,062 | 7/1978 | Adams | 36/72 R |
| 4,231,170 | 11/1980 | Griswold | 36/72 R |
| 4,342,159 | 8/1982 | Edwards | 36/77 R |
| 4,656,761 | 4/1987 | Lord | 36/77 R |

FOREIGN PATENT DOCUMENTS

| | | | |
|---|---|---|---|
| 1141950 | 3/1983 | Canada . | |
| 140977 | 4/1980 | German Democratic Rep. | 36/113 |
| 7612407 | 5/1978 | Netherlands | 36/77 R |

*Primary Examiner*—James K. Chi

*Attorney, Agent, or Firm*—McConnell and Fox

[57] ABSTRACT

A safety shoe including a metatarsal guard comprising a molded plastic arch extending across the metatarsal area supported at each of its ends on the sole and consisting of a number of ribs hinged to each other, the whole being laminated into the upper of the shoe.

4 Claims, 1 Drawing Sheet

SAFETY SHOE

FIELD OF THE INVENTION

This invention relates to a footwear and in particular to safety shoes used in industry in locations where there is danger from falling objects or other material striking and injuring the foot of the worker.

DESCRIPTION OF THE PRIOR ART

Safety shoes are commonly required in industry to protect the worker from inadvertent blows to the foot or crushing forces. Most safety shoes incorporate at least a steel box toe to protect the toe section. They may also include an arch guard incorporated into the sole of the shoe. It has also been proposed in the past to provide a metatarsal guard, that is a guard that protects the instep of the foot. Such guards have been proposed, for example, in Canadian Pat. No. 1,141,950 which relates to a molded plastic boot incorporating a metatarsal guard. The guard of Canadian Pat. No. 1,141,950, however, is a relatively rigid arch which is not able to flex with the foot in a normal walking mode. Other metatarsal guards are presently provided on leather boots in the form of a loosely attached member which is connected to the forward portion of the boot but not rigidly attached and therefore, while the guard is a rigid guard, the boot can flex underneath the guard. Such metatarsal guards are, however, dangerous in that they have a relatively free upper edge which may catch on steps of ladders or other equipment and therefore they constitute a risk to the user. They may also entrap falling material between the guard and the boot and such falling material itself may constitute a risk to the user. Such guards are, therefore, obviously most unsuitable for many industries.

SUMMARY OF THE INVENTION

In accordance with the present invention, a metatarsal guard is provided which is itself flexible and therefore may be incorporated within the boot providing no exterior protuberance or loose material which could engage or catch on machinery or equipment. The guard is laminated into the upper of the boot and, being flexible, permits the boot to flex and yet the metatarsal guard provides substantial protection for the user. Additional protection in addition to the mechanical strength of the metatarsal guard may be provided by a layer of thermally protective material above and below the actual mechanical portion of the metatarsal guard and the whole may be laminated into the upper of the boot.

A clearer understanding of our invention may be had from a consideration of the following description and drawings in which:

DESCRIPTION OF THE PREFERRED EMBODIMENT

Figures 1, 2A, 2B, 2C, 2D:
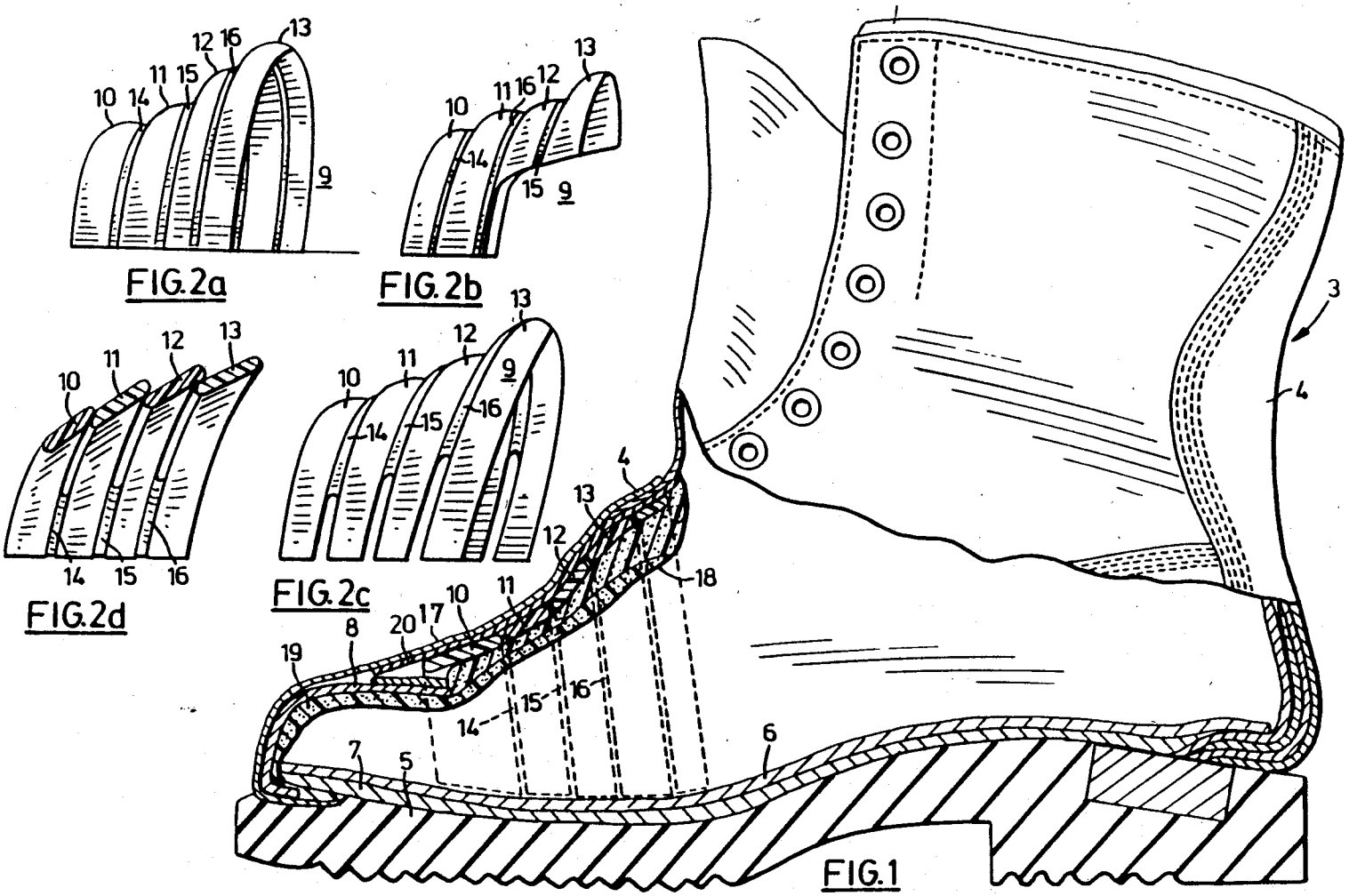
FIG. 1 is a boot partially in cross-section incorporating the metatarsal guard in accordance with my invention.
FIG. 2A is a view of the metatarsal guard separated from the boot.
FIG. 2B is a modified form of the guard.
FIG. 2C is a further modification of the guard
FIG. 2D is a further modification of the guard.

Considering first FIG. 1, there is shown a boot 3 including an upper generally designated 4, a bottom sole 5 vulcanized to the upper at its periphery, an insole 6 and a sole 7. Since this is a safety shoe it include a metallic box toe 8 and would probably include some arch protection (not shown) between the heel and the sole portion. The metatarsal guard 9 is a plastic molding consisting of a series of ribs 10, 11, 12 and 13, joined by webs 14, 15 and 16. The guard may be molded from any suitable plastic material, which is tough, flexible, relatively rigid but not brittle, such as polypropylene or ABS plastic. The guard forms an arch from the sole on one side of the instep to the sole on the other side of the instep and is therefore supported by the sole. The webs 14, 15 and 16 are simply areas of reduced cross-section which permit flexing of the guard.

As will be seen, the guard is laminated into the upper which consists of an outer layer of material designated 17, which may be leather or other suitable material such as leather-like man-made materials, and the liner 18 which may be a similar leather-like material and preferably has a foam layer to provide insulation, designated 19. An additional layer of heat protecting material is provided over the top of the metatarsal guard. Preferably, this insulating material is a fabric which is capable of withstanding high temperatures such as a silica fabric sold under the trademark "Zetex". Other inorganic insulating fabrics may also be used. Additional protection for the user may be provided by coating the fabric with aluminum which will provide heat reflection and therefore further protection to the wearer. Another layer of thermal protection may be provided on the inner side of the metatarsal guard. Both layers are designated 20.

The materials used in the construction of the boot are those normally used for such purposes, for example, the bottom sole 5 would normally be made of a composition rubbery material. It may be joined to the upper by various processes including vulcanization, the cement process, a Goodyear welt, injection molding, stitch down, stick down or string last. The sole section 7 may be made of any suitable material, it is usually a substance referred to as insole board. As has previously been indicated, the upper 4 can be made of any material suitable for the purpose. Leather is conventionally used although man-made materials having similar properties may also be useful. Since the metatarsal guard is located in exactly the point where maximum flexure will occur in the normal act of walking, it is necessary that the guard should be flexible. Web members 14, 15 and 16 are provided between the ribs to permit the ribs to hinge relative to each other and thus permit flexing of the boot.

It will be understood, however, that in flexing the top portion of the ribs must move closer to each other and the lower portion must move apart. Alternative forms of guards may be desirable to increase the flexibility, for example, considering FIG. 2B it will be seen that the lower portion of the guard has been cut away in the direction away from the toe of the boot. While there has been some loss of protection in the metatarsal area because the rear portion of the guard is not supported by the sole, substantial protection is still provided and increased flexibility is obviously provided.

A further alternative arrangement is shown in FIG. 2C. Here the web portions 14, 15 and 16 have been cut away at the lower portion of guard 9 thus permitting the ribs 10, 11, 12 and 13 to move apart when flexed. This also increases the flexibility of the guard while not substantially decreasing its protective qualities and arch form structure.

A further alternative is shown in FIG. 2D where the web portion has been removed from the upper portion of the guard. It will be seen, however, in this case the ribs 10, 11, 12 and 13 overlap so that in its unflexed position there are no spaces between the ribs. However, when flexed, one tibs slides under the other, for example, rib 11 slips under rib 10, thus providing increased flexibility with only minimal loss of strength.

It will be seen that in all cases the metatarsal guard rib 10 projects slightly over the metallic box toe. This provides a satisfactory prevention against any material falling between the two guards.

The various dimensions of the ribs, the webs and the guard as a whole may, of course, be adjusted to satisfy the requirements of any particular installation, however, it will be understood that the thickness should be sufficient to provide the protection required for the particular location without substantially increasing weight and the flexibility of the shoe thus inconveniencing the user.

We claim as our invention:

1. A safety shoe including a sole, a toe guard mounted on the front of said sole, an upper fastened to said sole at its periphery and enclosing said toe guard, a liner for said upper, a metatarsal guard unitarily molded from a tough resilient flexible plastic laminated between said upper and said liner extending from said toe guard to a point adjacent the front of the ankle of said shoe, said metatarsal guard comprising a plurality of ribs hingedly joined to each other forming a unitary arch shaped structure extending from said sole on one side of the shoe to said sole on the other side of the shoe and forming a continuous guard between the interior and exterior of said shoe.

2. A safety shoe as claimed in claim 1 wherein said ribs ar joined to each other only at their upper central portions.

3. A safety shoe as claimed in claim 1 wherein said ribs are joined to each other only at their ends adjacent said sole and their upper central portions are separate but overlap to form a continuous guard from said toe cap to the front ankle portion of said shoe.

4. A safety shoe as claimed in claim 3 wherein said metatarsal guard is covered with a fire resistent, thermally insulating, fabric including a heat reflecting layer.

* * * * *